US006730866B1

(12) United States Patent
Wong et al.

(10) Patent No.: US 6,730,866 B1
(45) Date of Patent: May 4, 2004

(54) HIGH-FREQUENCY, LIQUID METAL, LATCHING RELAY ARRAY

(75) Inventors: Marvin Glenn Wong, Woodland Park, CO (US); Arthur Fong, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/413,278

(22) Filed: Apr. 14, 2003

(51) Int. Cl.[7] ..... H01H 29/00
(52) U.S. Cl. ..... 200/182; 200/190; 200/234
(58) Field of Search ..... 200/182, 190, 200/193, 214, 234, 199

(56) References Cited

U.S. PATENT DOCUMENTS

| | | | | | |
|---|---|---|---|---|---|
| 2,312,672 A | * | 3/1943 | Pollard, Jr. | ..... | 335/58 |
| 2,564,081 A | * | 8/1951 | Schilling | ..... | 335/56 |
| 3,430,020 A | | 2/1969 | Tomkewitsch et al. | | |
| 3,529,268 A | * | 9/1970 | Rauterberg | ..... | 335/56 |
| 3,600,537 A | | 8/1971 | Twyford | | |

(List continued on next page.)

FOREIGN PATENT DOCUMENTS

| | | | |
|---|---|---|---|
| EP | 0593836 A1 | | 4/1994 |
| FR | 2418539 | | 9/1979 |
| FR | 2458138 | | 12/1980 |
| FR | 2667396 | | 4/1992 |
| JP | SHO 36-18575 | | 10/1961 |
| JP | SHO 47-21645 | | 10/1972 |
| JP | 3276838 | * | 5/1987 |
| JP | 1294317 | * | 5/1988 |
| JP | 8-125487 | | 5/1996 |
| JP | 9161640 | | 6/1997 |
| WO | WO99/46624 | | 12/1999 |

OTHER PUBLICATIONS

Jonathan Simon, "A Liquid–Filled Microrelay With A Moving Mercury Microdrop" (Sep. 1997), Journal of Microelectromechinical Systems, vol. 6, No. 3. pp 208–216.

Marvin Glenn Wong, "A Piezoelectrically Actuated Liquid Metal Switch", May 2, 2002, patent application (pending, 12 pages of specification, 5 pages of claims, 1 page of abstract, and 10 sheets of drawings (Figs. 1–10).

TDB–ACC–NO:NB8406827, "Integral Power Resistors for Aluminum Substrate", IBM Technical Disclosure Bulletin, Jun. 1984, US, vol. 27, Issue No. 1B, Pg. 827.

(List continued on next page.)

*Primary Examiner*—Michael Friedhofer
*Assistant Examiner*—Lisa Klaus

(57) ABSTRACT

An electrical relay array using conducting liquid in the switching mechanism. The relay array is amenable to manufacture by micro-machining techniques. In each element of the relay array, two electrical contacts are held a small distance apart. The facing surfaces of the contacts each support a droplet of a conducting liquid, such as a liquid metal. An actuator, coupled to one of the electrical contacts, is energized in a first direction to reduce the gap between the electrical contacts, causing the two conducting liquid droplets to coalesce and complete an electrical circuit. The actuator is then de-energized and the contacts return to their starting position. The liquid droplets remain coalesced because of surface tension. The electrical circuit is broken by energizing an actuator to increase the gap between the electrical contacts to break the surface tension bond between the conducting liquid droplets. The droplets remain separated when the actuator is de-energized because there is insufficient conducting liquid to bridge the gap between the contacts. Additional conductors may be included in the assembly to provide a coaxial structure and allow for high frequency switching. In an exemplary embodiment, the actuator is a piezoelectric actuator and the conducting liquid is a liquid metal.

16 Claims, 8 Drawing Sheets

U.S. PATENT DOCUMENTS 3,639,165 A 2/1972 Rairden, III
365,764 A 4/1972 Beusman et al.
3,657,647 A * 4/1972 Beusman et al. ..... 324/94
4,103,135 A 7/1978 Gomez et al.
4,200,779 A 4/1980 Zakurdaev et al.
4,238,748 A 12/1980 Goullin et al.
4,245,886 A 1/1981 Kolodzey et al.
4,336,570 A 6/1982 Brower et al.
4,419,650 A 12/1983 John
4,434,337 A * 2/1984 Becker ..... 200/220
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A * 5/1998 Prior et al. ..... 307/118
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 * 1/2001 Bitko ..... 174/9 F
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

OTHER PUBLICATIONS

Bhedwar, Homi C., et al., "Ceramic Multilayer Package Fabrication," Electronic Materials Handbook, Nov. 1989, pp. 460–469, vol. 1 Packaging, Section 4; Packages.
Kim, Joonwon, et al., "A Micromechanical Switch with Electrostatistically Driven Liquid–Metal Droplet." Sensors and Actuators, A: Physical. v 9798, Apr. 1, 2002, 4 pages.

* cited by examiner

HIGH-FREQUENCY, LIQUID METAL, LATCHING RELAY ARRAY

CROSS REFERENCE TO RELATED APPLICATIONS

This application is related to the following U.S. Patent Applications, being identified by the below enumerated identifiers and arranged in alphanumerical order, which have the same ownership as the present application and to that extent are related to the present application and which are hereby incorporated by reference:

Application 10010448-1, titled "Piezoelectrically Actuated Liquid Metal Switch", filed May 2, 2002 and identified by Ser. No. 10/137,691;

Application 10010529-1, "Bending Mode Latching Relay", and having the same filing date as the present application;

Application 10010531-1, "High Frequency Bending Mode Latching Relay", and having the same filing date as the present application;

Application 10010570-1, titled "Piezoelectrically Actuated Liquid Metal Switch", filed May 2, 2002 and identified by Ser. No. 10/142,076;

Application 10010571-1, "High-frequency, Liquid Metal, Latching Relay with Face Contact", and having the same filing date as the present application;

Application 10010572-1, "Liquid Metal, Latching Relay with Face Contact", and having the same filing date as the present application;

Application 10010573-1, "Insertion Type Liquid Metal Latching Relay", and having the same filing date as the present application;

Application 10010618-1; "Insertion Type Liquid Metal Latching Relay Array", and having the same filing date as the present application;

Application 10010634-1, "Liquid Metal Optical Relay", and having the same filing date as the present application;

Application 10010640-1, titled "A Longitudinal Piezoelectric Optical Latching Relay", filed Oct. 31, 2001 and identified by Ser. No. 09/999,590;

Application 10010643-1, "Shear Mode Liquid Metal Switch", and having the same filing date as the present application;

Application 10010644-1, "Bending Mode Liquid Metal Switch", and having the same filing date as the present application;

Application 10010656-1, titled "A Longitudinal Mode Optical Latching Relay", and having the same filing date as the present application;

Application 10010663-1, "Method and Structure for a Pusher-Mode Piezoelectrically Actuated Liquid Metal Switch", and having the same filing date as the present application;

Application 10010664-1, "Method and Structure for a Pusher-Mode Piezoelectrically Actuated Liquid Metal Optical Switch", and having the same filing date as the present application;

Application 10010790-1, titled "Switch and Production Thereof", filed Dec. 12, 2002 and identified by Ser. No. 10/317,597;

Application 10011055-1, "High Frequency Latching Relay with Bending Switch Bar", and having the same filing date as the present application;

Application 10011056-1, "Latching Relay with Switch Bar", and having the same filing date as the present application;

Application 10011064-1, "High Frequency Push-mode Latching Relay", and having the same filing date as the present application;

Application 10011065-1, "Push-mode Latching Relay", and having the same filing date as the present application;

Application 10011121-1, "Closed Loop Piezoelectric Pump", and having the same filing date as the present application;

Application 10011329-1, titled "Solid Slug Longitudinal Piezoelectric Latching Relay", filed May 2, 2002 and identified by Ser. No. 10/137,692;

Application 10011344-1, "Method and Structure for a Slug Pusher-Mode Piezoelectrically Actuated Liquid Metal Switch", and having the same filing date as the present application;

Application 10011345-1, "Method and Structure for a Slug Assisted Longitudinal Piezoelectrically Actuated Liquid Metal Optical Switch", and having the same filing date as the present application;

Application 10011397-1, "Method and Structure for a Slug Assisted Pusher-Mode Piezoelectrically Actuated Liquid Metal Optical Switch", and having the same filing date as the present application;

Application 10011398-1, "Polymeric Liquid Metal Switch", and having the same filing date as the present application;

Application 10011410-1, "Polymeric Liquid Metal Optical Switch", and having the same filing date as the present application;

Application 10011436-1, "Longitudinal Electromagnetic Latching Optical Relay", and having the same filing date as the present application;

Application 10011437-1, "Longitudinal Electromagnetic Latching Relay", and having the same filing date as the present application;

Application 10011458-1, "Damped Longitudinal Mode Optical Latching Relay", and having the same filing date as the present application;

Application 10011459-1, "Damped Longitudinal Mode Latching Relay", and having the same filing date as the present application;

Application 10020013-1, titled "Switch and Method for Producing the Same", filed Dec. 12, 2002 and identified by Ser. No. 10/317,963;

Application 10020027-1, titled "Piezoelectric Optical Relay", filed Mar. 28, 2002 and identified by Ser. No. 10/109,309;

Application 10020071-1, titled "Electrically Isolated Liquid Metal Micro-Switches for Integrally Shielded Microcircuits", filed Oct. 8, 2002 and identified by Ser. No. 10/266,872;

Application 10020073-1, titled "Piezoelectric Optical Demultiplexing Switch", filed Apr. 10, 2002 and identified by Ser. No. 10/119,503;

Application 10020162-1, titled "Volume Adjustment Apparatus and Method for Use", filed Dec. 12, 2002 and identified by Ser. No. 10/317,293;

Application 10020241-1, "Method and Apparatus for Maintaining a Liquid Metal Switch in a Ready-to-Switch Condition", and having the same filing date as the present application;

Application 10020242-1, titled "A Longitudinal Mode Solid Slug Optical Latching Relay", and having the same filing date as the present application;

Application 10020473-1, titled "Reflecting Wedge Optical Wavelength Multiplexer/Demultiplexer", and having the same filing date as the present application;

Application 10020540-1, "Method and Structure for a Solid Slug Caterpillar Piezoelectric Relay", and having the same filing date as the present application;

Application 10020541-1, titled "Method and Structure for a Solid Slug Caterpillar Piezoelectric Optical Relay", and having the same filing date as the present application;

Application 10030438-1, "Inserting-finger Liquid Metal Relay", and having the same filing date as the present application;

Application 10030440-1, "Wetting Finger Liquid Metal Latching Relay", and having the same filing date as the present application;

Application 10030521-1, "Pressure Actuated Optical Latching Relay", and having the same filing date as the present application;

Application 10030522-1, "Pressure Actuated Solid Slug Optical Latching Relay", and having the same filing date as the present application; and Application 10030546-1, "Method and Structure for a Slug Caterpillar Piezoelectric Reflective Optical Relay", and having the same filing date as the present application.

FIELD OF THE INVENTION

The invention relates to the field of micro-electromechanical systems (MEMS) for electrical switching and, in particular, to a high-frequency, piezoelectrically actuated, latching relay array with liquid metal contacts.

BACKGROUND OF THE INVENTION

Liquid metals, such as mercury, have been used in electrical switches to provide an electrical path between two conductors. An example is a mercury thermostat switch, in which a bimetal strip coil reacts to temperature and alters the angle of an elongated cavity containing mercury. The mercury in the cavity forms a single droplet due to high surface tension. Gravity moves the mercury droplet to the end of the cavity containing electrical contacts or to the other end, depending upon the angle of the cavity. In a manual liquid metal switch, a permanent magnet is used to move a mercury droplet in a cavity.

Liquid metal is also used in relays. A liquid metal droplet can be moved by a variety of techniques, including electrostatic forces, variable geometry due to thermal expansion/contraction and magneto-hydrodynamic forces.

Conventional piezoelectric relays either do not latch or use residual charges in the piezoelectric material to latch or else activate a switch that contacts a latching mechanism.

Rapid switching of high currents is used in a large variety of devices, but provides a problem for solid-contact based relays because of arcing when current flow is disrupted. The arcing causes damage to the contacts and degrades their conductivity due to pitting of the electrode surfaces.

Micro-switches have been developed that use liquid metal as the switching element and the expansion of a gas when heated to move the liquid metal and actuate the switching function. Liquid metal has some advantages over other micro-machined technologies, such as the ability to switch relatively high powers (about 100 mW) using metal-to-metal contacts without micro-welding or overheating the switch mechanism. However, the use of heated gas has several disadvantages. It requires a relatively large amount of energy to change the state of the switch, and the heat generated by switching must be dissipated effectively if the switching duty cycle is high. In addition, the actuation rate is relatively slow, the maximum rate being limited to a few hundred Hertz.

SUMMARY

An electrical relay array is disclosed. In each element of the relay array, two electrical contacts are held a small distance apart. The facing surfaces of the contacts each support a droplet of a conducting liquid, such as a liquid metal. In an exemplary embodiment, a piezoelectric actuator, coupled to one of the electrical contacts, is preferably energized in a first direction to reduce the gap between the electrical contacts, causing the two conducting liquid droplets to coalesce and complete an electrical circuit. The piezoelectric actuator is then de-energized and the contacts return to their starting position. The liquid metal droplets remain coalesced because of surface tension. The electrical circuit is broken by energizing a piezoelectric actuator to increase the gap between the electrical contacts to break the surface tension bond between the conducting liquid droplets. The droplets remain separated when the piezoelectric actuator is de-energized because there is insufficient conducting liquid to bridge the gap between the contacts. Additional conductors may be included in the assembly to provide a coaxial structure and allow for high frequency switching. The relay array is amenable to manufacture by micro-machining techniques.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION

Figure 1:
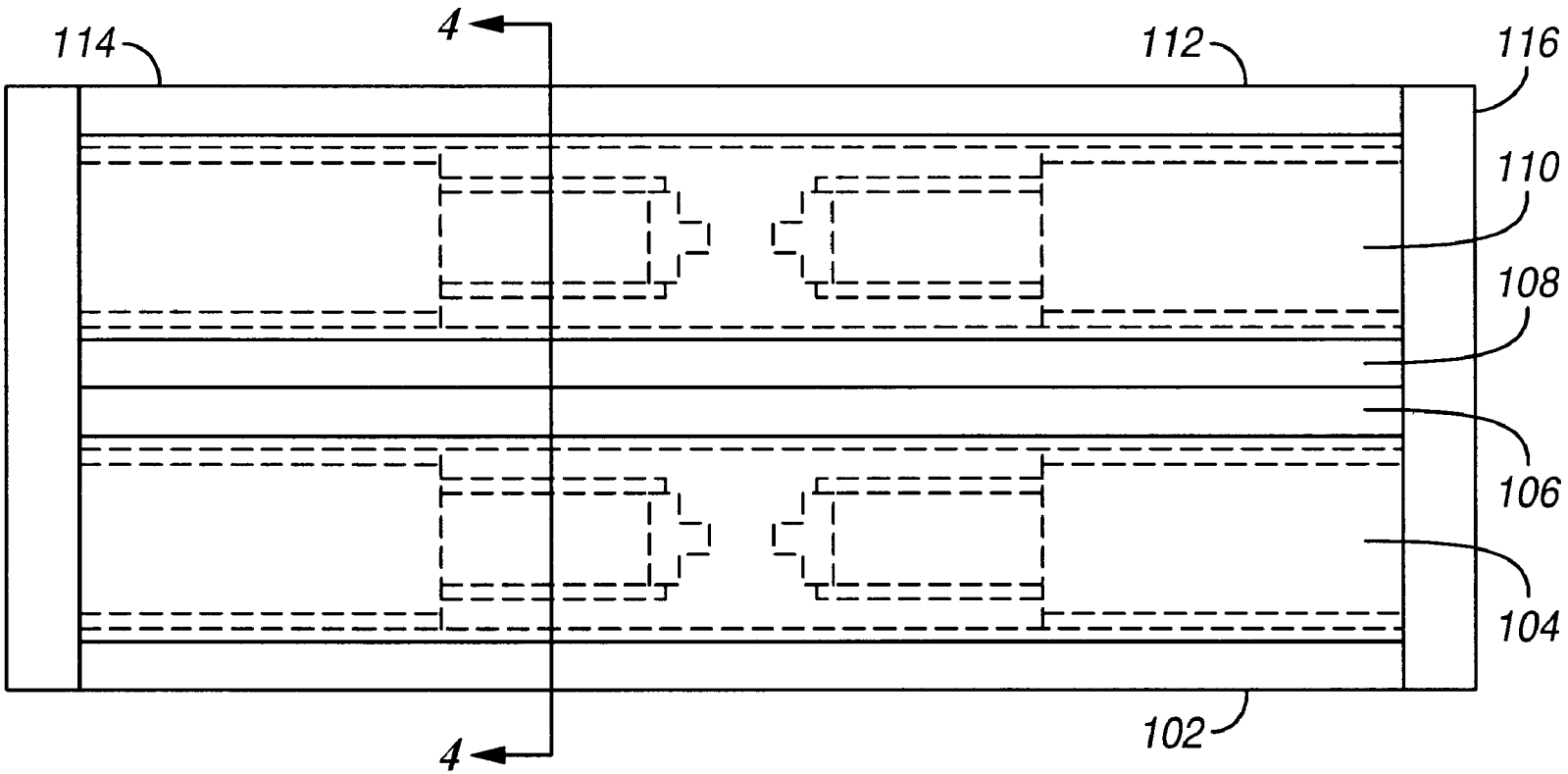
FIG. 1 is a view of an exemplary embodiment of a latching relay array in accordance with certain embodiments of the present invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several views of the drawings.

The electrical relay array of the present invention comprises a number of relay elements. In one embodiment, each element operates independently of the others. In a further embodiment, the elements act in concert to form a relay array that may be used for multi-channel switching or multiplexing. Each relay in the array uses a conducting liquid, such as liquid metal, to bridge the gap between two electrical contacts and thereby complete an electrical circuit between the contacts. The two electrical contacts are held a small distance apart. Each of the facing surfaces of the contacts supports a droplet of a conducting liquid. In an exemplary embodiment, the conducting liquid is a liquid metal, such as mercury, with high conductivity, low volatility and high surface tension. An actuator is coupled to the first electrical contact. In an exemplary embodiment the actuator is a piezoelectric actuator, but other actuators, such as magnetostrictive actuators, may be used. In the sequel, piezoelectric and magnetorestrictive will be collectively referred to as "piezoelectric".

When energized, the actuator moves the first electrical contact towards the second electrical contact, causing the two conducting liquid droplets to coalesce and complete an electrical circuit between the contacts. The piezoelectric actuator is then de-energized and the first electrical contact returns to its starting position. The conducting liquid droplets remain coalesced because of surface tension. In this manner, the relay is latched. The electrical circuit is broken by energizing a piezoelectric actuator to move the first electrical contact away from the second electrical contact to break the surface tension bond between the conducting liquid droplets. The droplets remain separated when the piezoelectric actuator is de-energized because there is insufficient liquid to bridge the gap between the contacts. The relay is amenable to manufacture by micro-machining techniques.

In an exemplary embodiment, the array preferably comprises one or more stacked levels, with each level containing one on more relays positioned side-by side. In this way, a rectangular grid of relays is formed. FIG. 1 is a view of an exemplary embodiment of a latching relay of the present invention. Referring to FIG. 1, the relay 100 comprises two levels. The lower level contains a lower cap layer 102, a switching layer 104 and an upper cap layer 106. The upper level has a similar structure and contains a lower cap layer 108, a switching layer 110 and an upper cap layer 112. The lower cap layers 102 and 108 support electrical connections to the elements in the switching layer and provide lower caps to the switching layer. The electrical connections are routed to end caps 114 and 116 that provide additional circuit routing and provide interconnections to the relay array. The circuit layers 102 and 108 may be made of a ceramic or silicon, for example, and are amenable to manufacture by micro-machining techniques, such as those used in the manufacture of micro-electronic devices. The switching layers 104 and 110 may be made of ceramic or glass, for example, or may be made of metal coated with an insulating layer (such as a ceramic).

Figure 2:
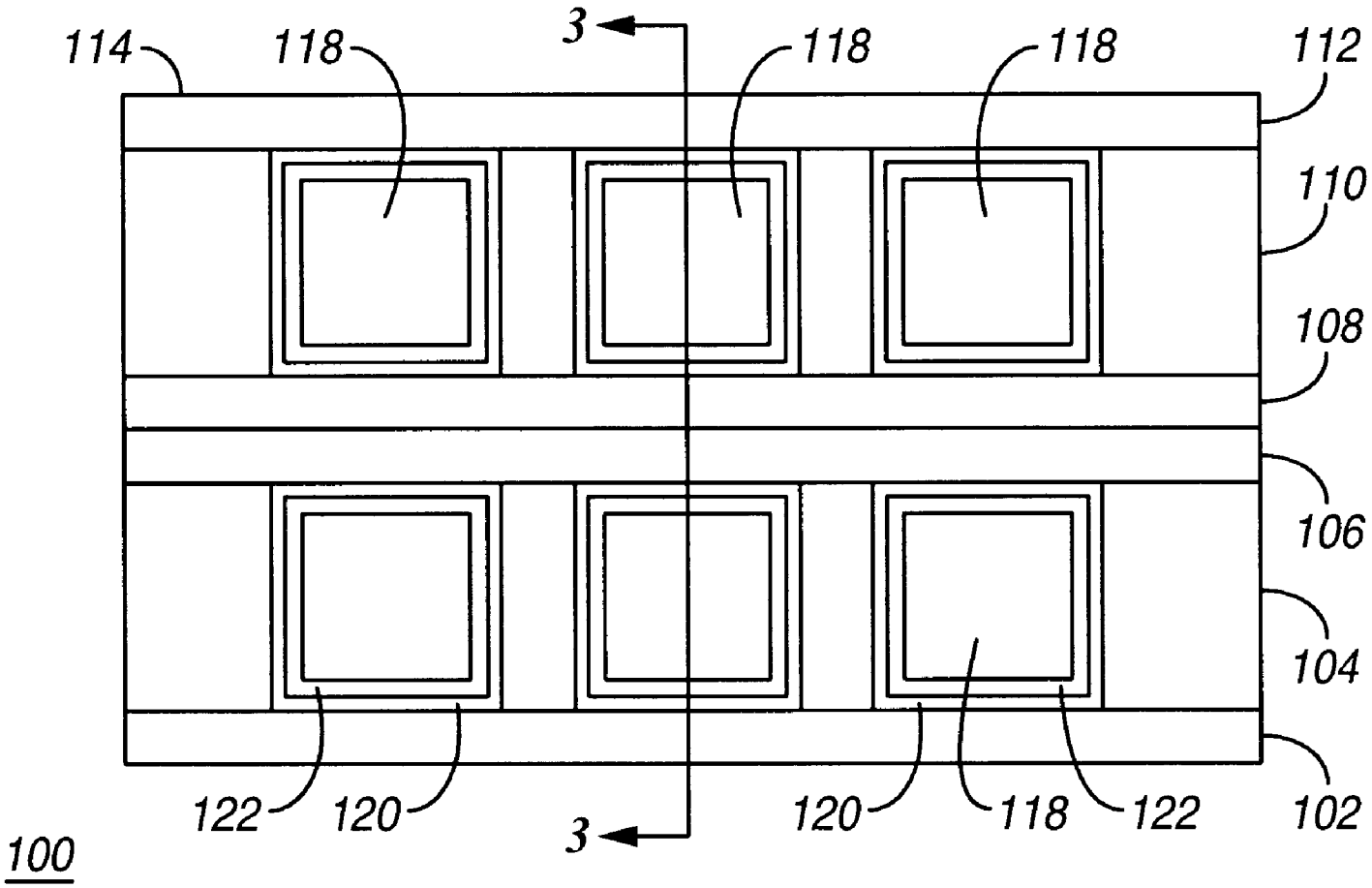
FIG. 2 is an end view of a latching relay array in accordance with certain embodiments of the present invention.

FIG. 2 is an end view of the relay array shown in FIG. 1 with the end cap removed. Referring to FIG. 2, three channels pass through each of the switching layers 104 and 110. At one end of each channel is a signal conductor 118 that is electrically coupled to one of the switch contacts of the relay. Optionally, ground shields 120 may surround each of the switching channels. The ground shields are electrically insulated from the signal conductors 118 by dielectric layers 122. In an exemplary embodiment, the ground shields 120 preferably are in part formed as traces deposited on the under side of the upper cap layers 106 and 112 and on the upper side of the lower cap layers 102 and 108. The upper cap layers 106 and 112 cover and seal the switching layers 104 and 110, respectively. The upper cap layers 106 and 112 may be made of ceramic, glass, metal or polymer, for example, or combinations of these materials. Glass, ceramic or metal is preferably used in an exemplary embodiment to provide a hermetic seal.

Figure 3:
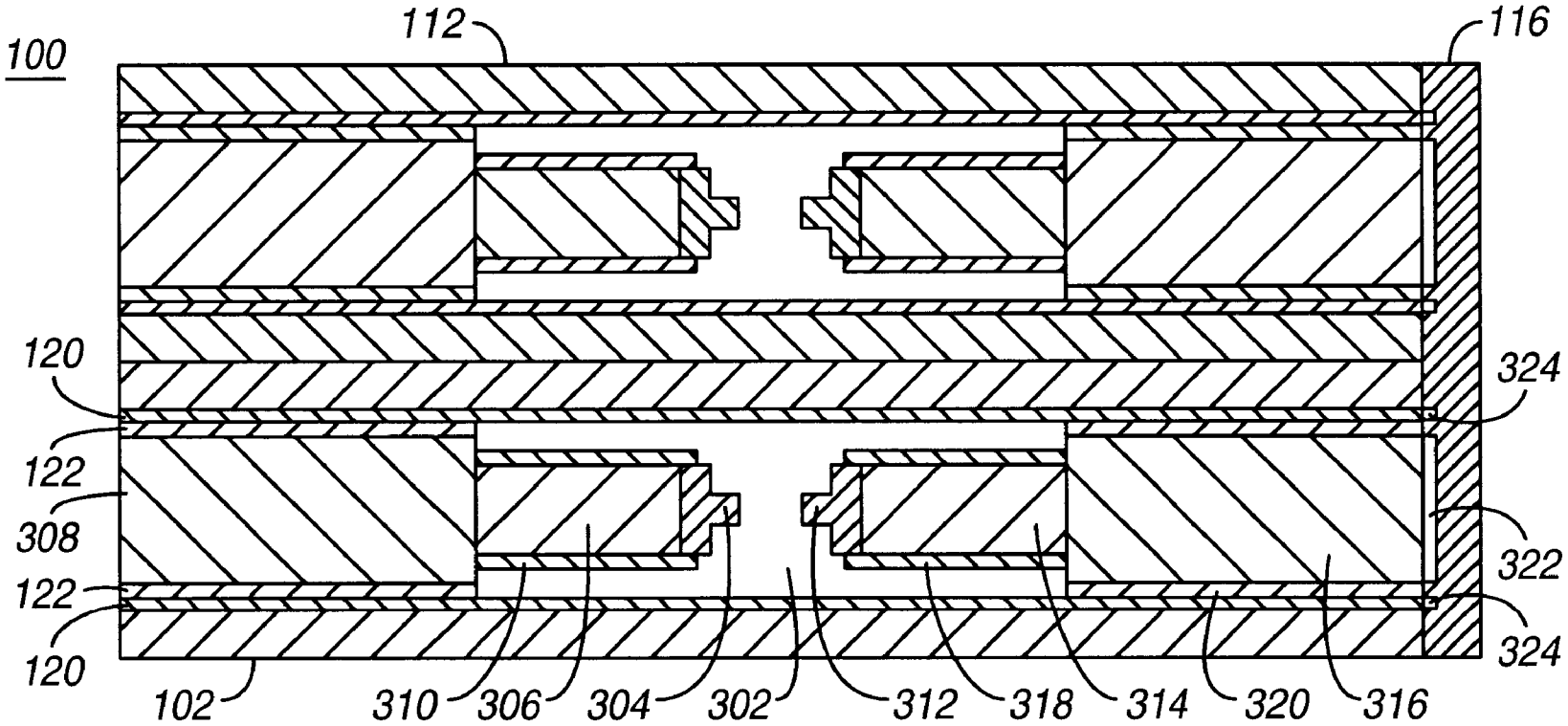
FIG. 3 is a sectional view of a latching relay array in accordance with certain embodiments of the present invention.

FIG. 3 is a sectional view of an embodiment of a latching relay 100 of the present invention with the end caps removed. The section is denoted by 3—3 in FIG. 2. Referring to FIG. 3, each switching layer incorporates a switching cavity 302. The cavity may be filled with an inert gas. A first electrical contact 304 is situated within the cavity 302. A first actuator 306 is attached to the signal conductor 308 at one end and supports the first electrical contact 304 at the other end. In operation, the length of the actuator 306 is increased or decreased to move the first electrical contact 304. In an exemplary embodiment, the actuator is preferably a piezoelectric actuator. A non-wetting, conductive coating 310 surrounds the first actuator 306 and electrically couples the contact 304 to the signal conductor 308. A second electrical contact 312 is situated within the cavity 302 facing the first electrical contact 304. A second actuator 314 is attached to the signal conductor 316 at one end and supports the second electrical contact 312 at the other end. In operation, the length of the actuator 314 is increased or decreased to move the second electrical contact 312. In an alternative embodiment, the second actuator 314 is omitted, and the second contact 312 is supported by the signal conductor 316. A non-wetting, conductive coating 318 surrounds second actuator 314 and electrically couples the contact 312 to the signal conductor 316. Other relays in the array have a similar construction.

The facing surfaces of the first and second electrical contacts are wettable by a conducting liquid. In operation, these surfaces support droplets of conducting liquid, held in place by the surface tension of the fluid. Due to the small size of the droplets, the surface tension dominates any body forces on the droplets and so the droplets are held in place. In an exemplary embodiment, the electrical contacts 304 and 312 preferably have a stepped surface. This increases the surface area and provides a reservoir for the conducting liquid. The actuators 306 and 314 are coated with non-wetting, conducting coatings 310 and 318, respectively. The coatings 310 and 318 electrically couple the contacts 304 and 312 to the signal conductors 308 and 316, respectively, and prevent migration of the conducting liquid along the actuators. Signal conductor 316 is electrically insulated from the ground traces by dielectric layer 320. Other relays in the relay array have similar structures.

Also shown in FIG. 3 is the end cap 116. The end cap 116 supports circuitry 322 to enable connection to the signal conductor 316, and circuitry 324 to connect to the ground shield 120. These circuits are led to the edges or the outer surface of the end cap to allow external connection to the relay. Similar circuitry is provided to allow connection to each of the relays in the relay array.

Figure 4:
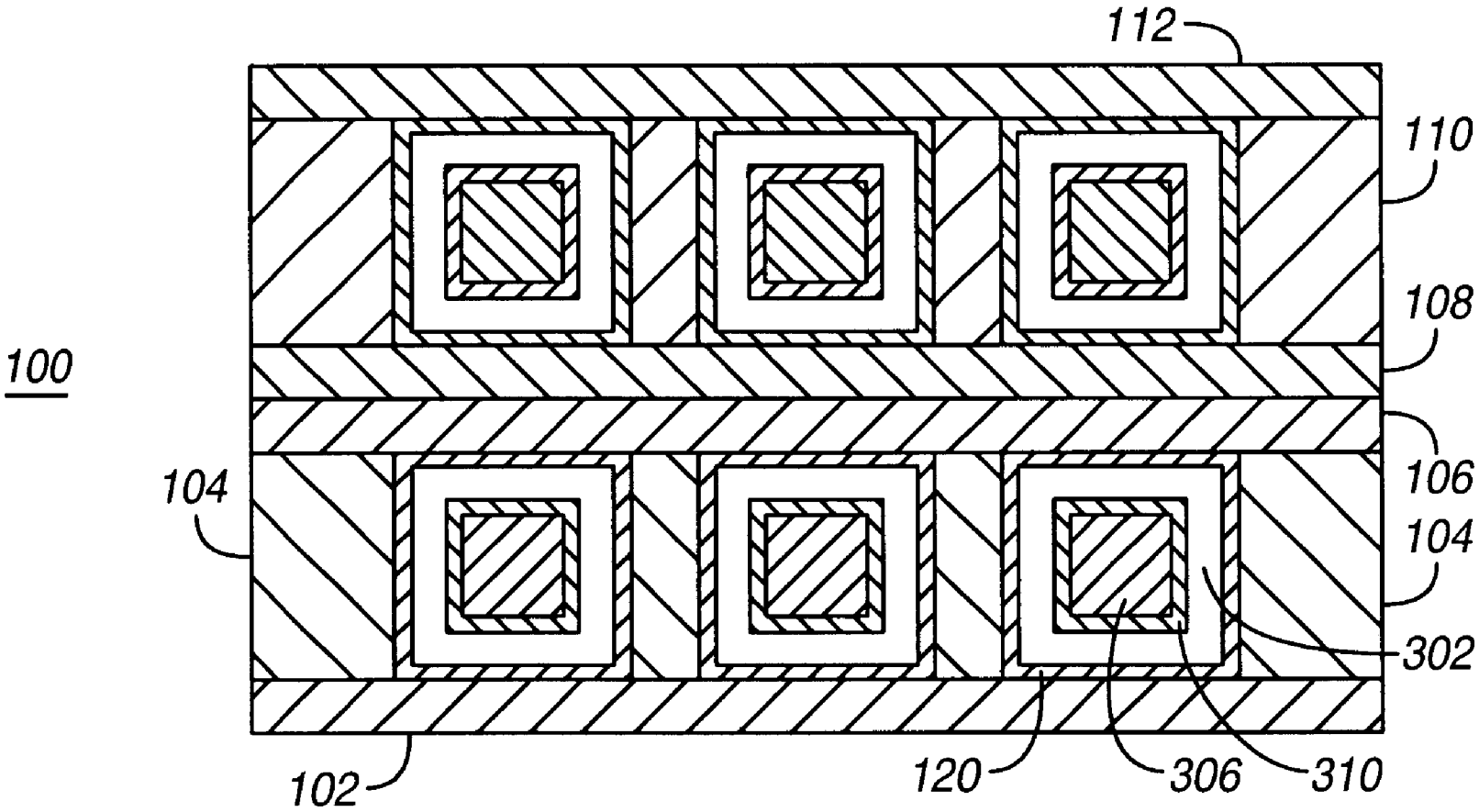
FIG. 4 is a further sectional view of a latching relay array in accordance with certain embodiments of the present invention.

FIG. 4 is a sectional view through section 4—4 of the latching relay shown in FIG. 1. The view shows the three layers of the lower level: the lower cap layer 102, the switching layer 104 and the upper cap layer 106, and the three layers of the upper level: the lower cap layer 108, the switching layer 110 and the upper cap layer 112. Referring to FIG. 4, the first actuator 306 is positioned within the switching cavity 302. The switching cavity 302 is sealed below by the lower cap layer 102 and sealed above by the upper cap layer 106. The optional ground shield 120 lines the channel in the switching layer and surrounds the actuator 306 and its non-wetting, conducting coating 310. This facilitates high frequency switching of the relay.

Figure 5:
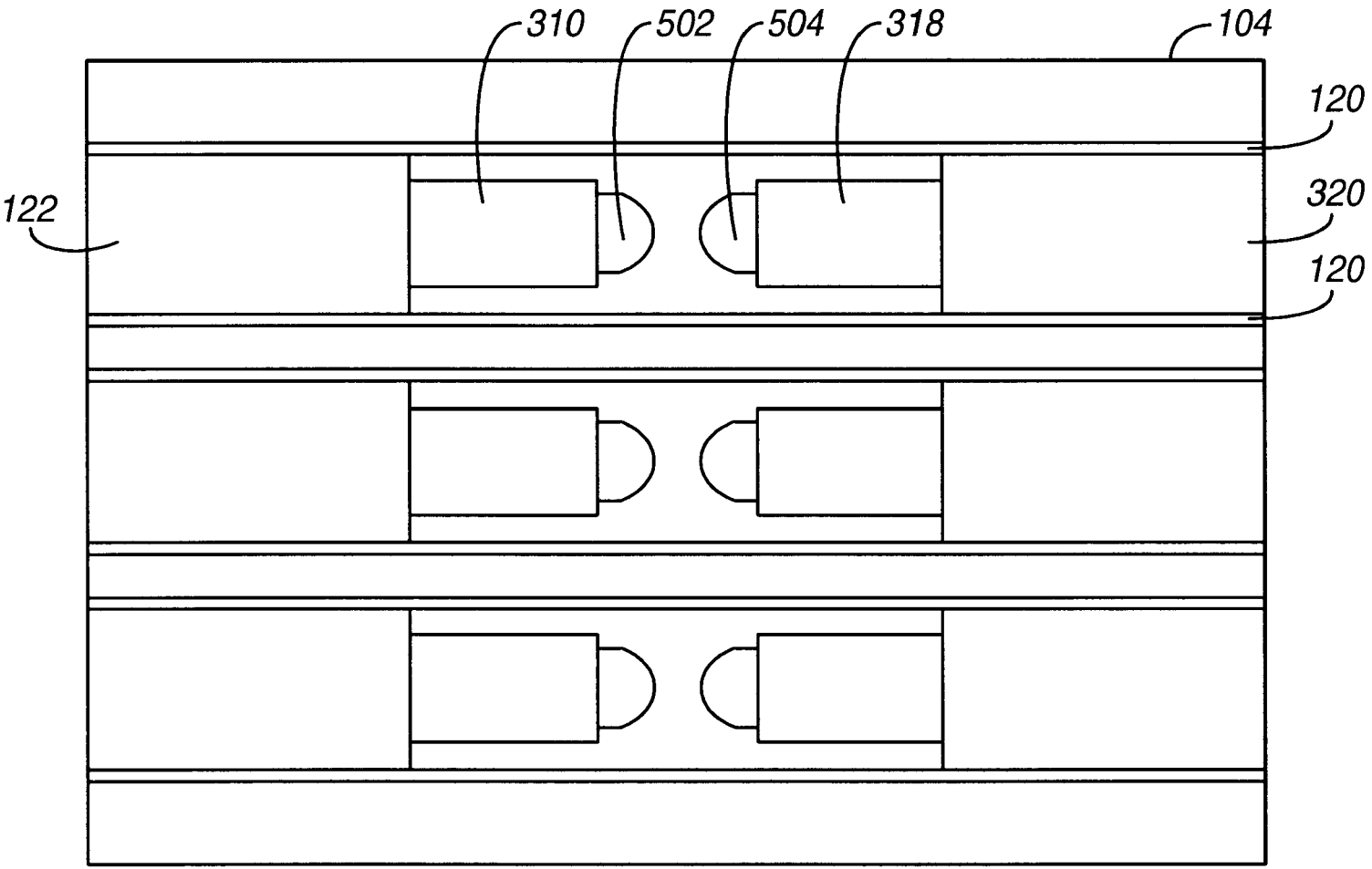
FIG. 5 is a view of a switching layer of a latching relay array in an open switch state in accordance with certain embodiments of the present invention.

FIG. 5 is a view of a relay array from above (relative to FIGS. 1 through 4) with the cap layer removed. The upper portion of the ground shield, which may be deposited on the lower surface of the upper cap layer, is also removed. The switching layer 104 incorporates the switching cavity formed in a channel between the two signal conductors that are covered by dielectric layers 122 and 320. Within the switching cavity are the first and second electrical contacts that are coated by conducting liquid droplets 502 and 504. Also in the channel are the actuators that are coated by non-wettable conductive coatings 310 and 318. The first electrical contact, wetted by the liquid droplet 502 is positioned facing the second electrical contact, wetted by liquid droplet 504. The second electrical contact may be attached directly to the second signal conductor or, as shown in the figure, it may be attached to the second actuator, with coating 318. The second actuator operates in opposition to the first actuator. Ground shield 120 lines the channel in the switching layer. The volume of the conducting liquid and the spacing between the contacts is such that there is insufficient liquid to bridge the gap between the contacts. When the liquid droplets are separated, as in FIG. 5, the electrical circuit between the contacts is open.

Figure 6:
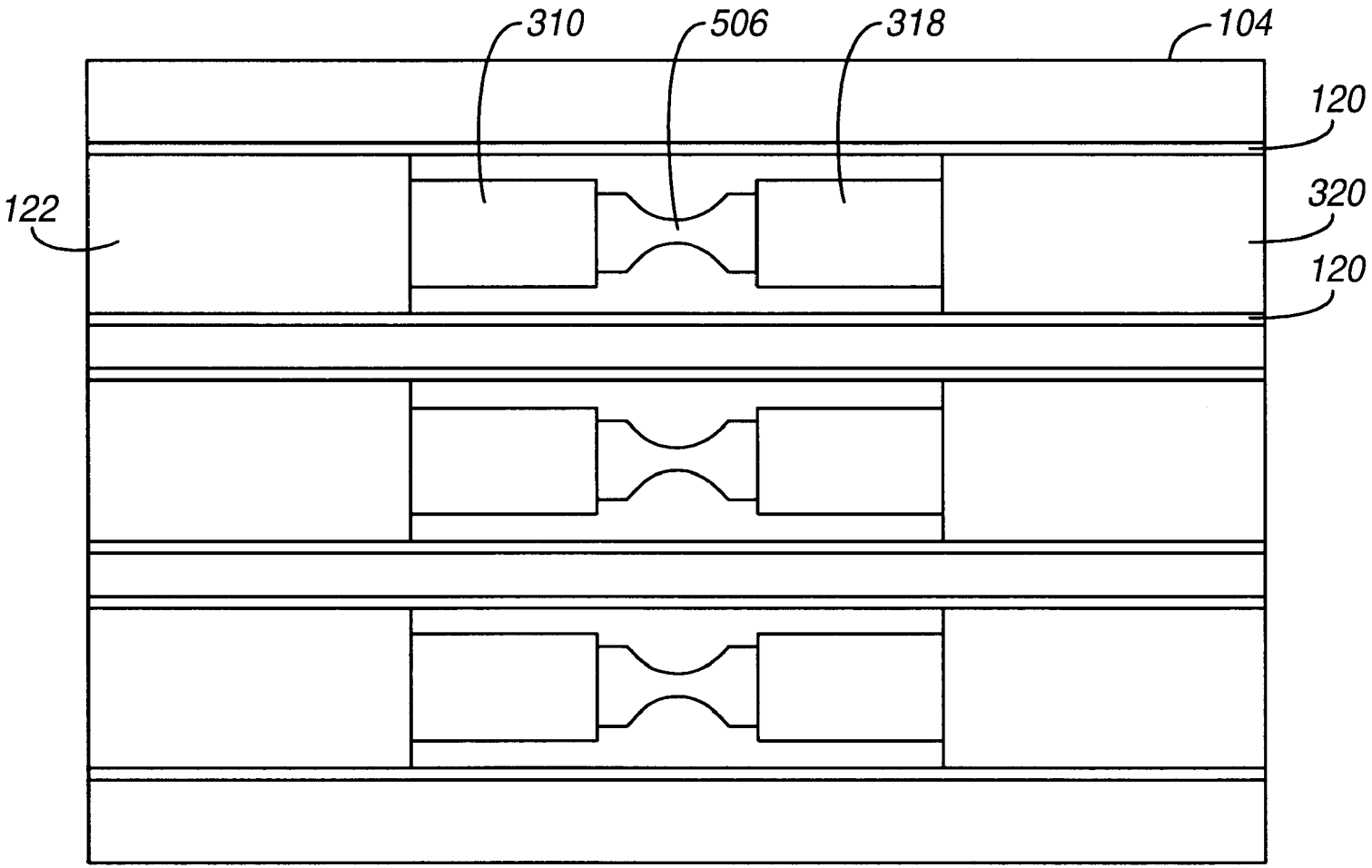
FIG. 6 is a view of a switching layer of a latching relay array in a closed switch state in accordance with certain embodiments of the present invention.

To complete the electrical circuit between the contacts, the contacts are moved together so that the two liquid droplets coalesce. This may be achieved by energizing one or both of the actuators. When the droplets have coalesced, the electrical circuit is completed. When the actuators are de-energized, the contacts return to their original positions. However, the volume of conducting liquid and the spacing of the contacts is such that the liquid droplets remain coalesced due to surface tension in liquid. This is shown in FIG. 6. Referring to FIG. 6, the two droplets remain coalesced as the single liquid volume 506. In this manner the relay is latched and the electrical circuit remains completed when the relay actuators are de-energized. When the electrical circuit is closed, the signal path is from the first signal conductor, through the first conductive coating, the first contact, the conducting liquid, the second contact and the second conductive coating, and finally through the second signal conductor. The ground conductor provides a shield surrounding the signal path. The use of mercury or other liquid metal with high surface tension to form a flexible, non-contacting electrical connection results in a relay with high current capacity that avoids pitting and oxide buildup caused by local heating. To break the electrical circuit again, the distance between the two electrical contacts is increased until the surface tension bond between the two liquid droplets is broken.

Figure 7:
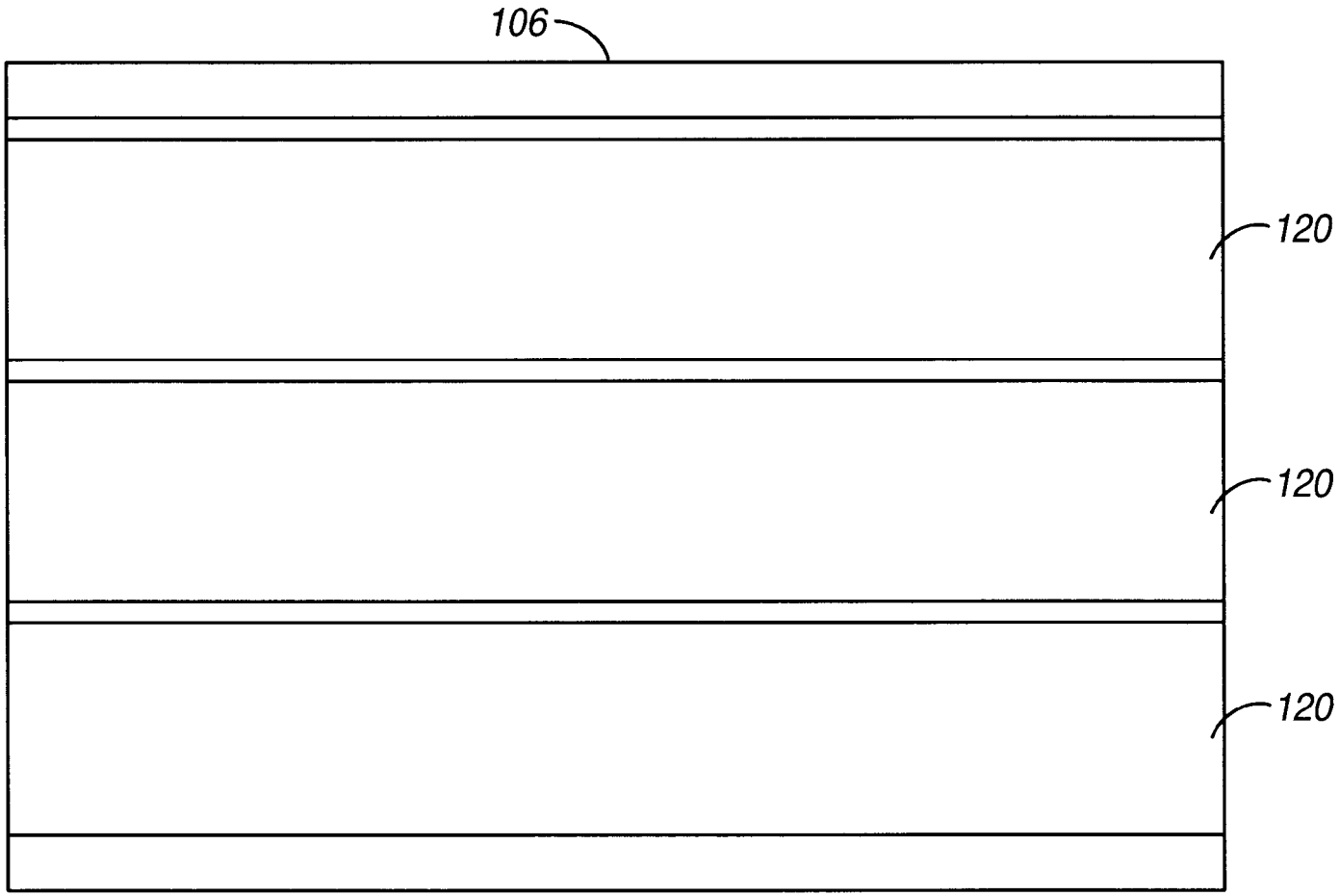
FIG. 7 is a view of a cap layer of a latching relay array in accordance with certain embodiments of the present invention.

FIG. 7 is a view of the lower surface of the upper cap layer 106. The upper cap layer 106 provides a seal for the channel in the switching layer. Ground traces 120, one for each switching channel in the switching layer, are deposited on the surface of the upper cap layer, and form one side of the ground shields that are coaxial with the signal conductors and switching mechanisms. Similar ground traces are deposited on the upper surface of the lower cap layer.

Figure 8:
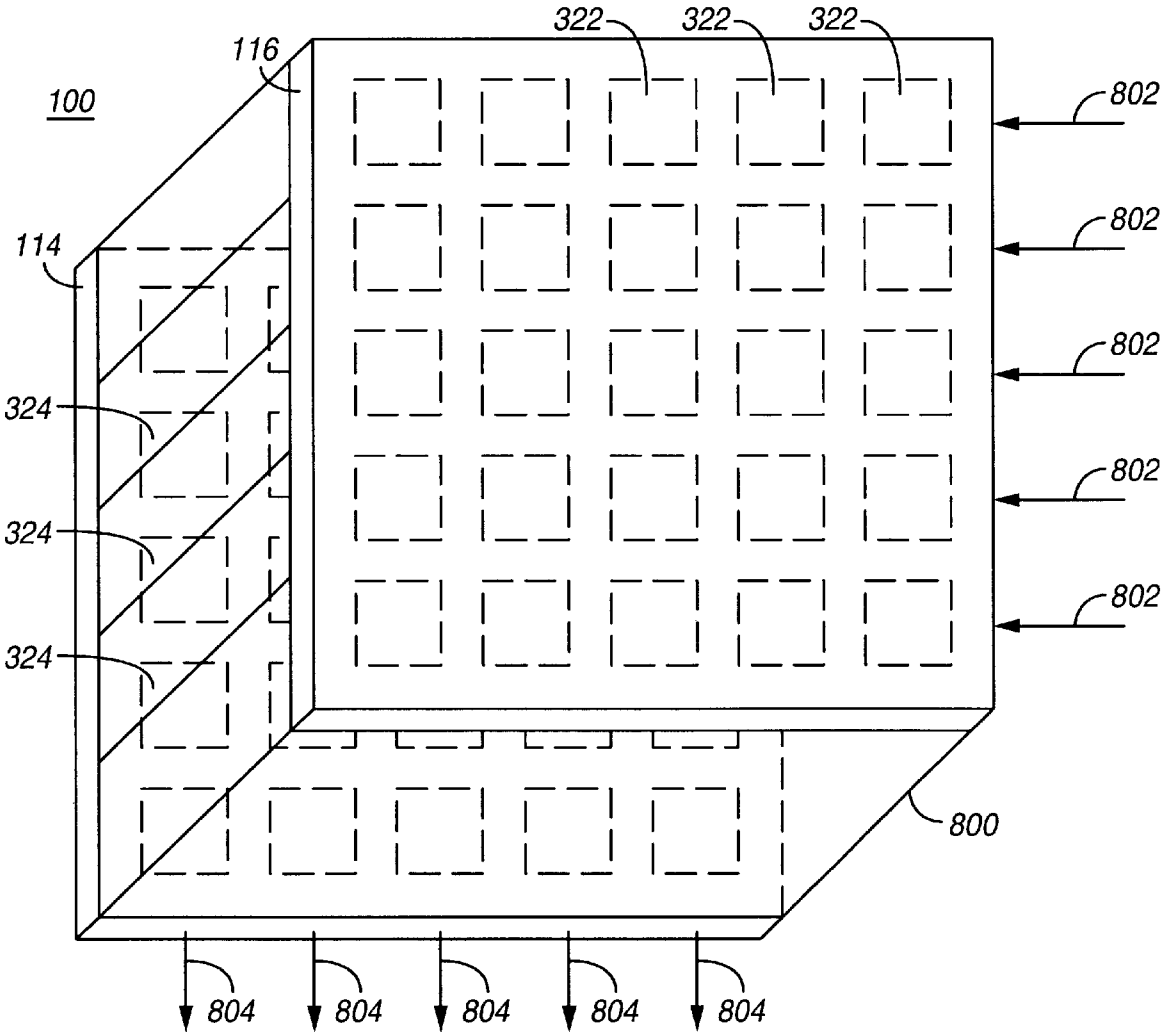
FIG. 8 is a view of a matrix multiplexer using a latching relay array in accordance with certain embodiments of the present invention.

FIG. 8 is a view of a further embodiment of the present invention. Shown in FIG. 8 is a five-level relay array 100 with five switching elements per level. The details of levels of the array body 800 are omitted for clarity. The first end cap 114 supports circuitry 324 to enable connection to the first signal conductors (not shown). The second end cap 116 supports circuitry 322 to enable connection to the second signal conductors. Additional circuitry (not shown) allows connections of input signals 802 to the connection circuitry 322 and for connection of the circuitry 324 to the outputs 804. In this embodiment, one input signal is provided for each level (row) of the array and one output signal is provided for each column of the array. The elements of the array allow any input signal to be coupled to any output. The array functions as a matrix signal multiplexer.

While the invention has been described in conjunction with specific embodiments, it is evident that many alternatives, modifications, permutations and variations will become apparent to those of ordinary skill in the art in light of the foregoing description. Accordingly, the present invention is intended to embrace all such alternatives, modifications and variations as fall within the scope of the appended claims.

What is claimed is:

1. An electrical relay array comprising a plurality of switching elements, a switching element of the plurality of switching elements comprising:

a first electrical contact, having a wettable surface;

a first signal conductor, electrically coupled to the first electrical contact;

a first conducting liquid droplet in wetted contact with the first electrical contact;

a second electrical contact, spaced from and aligned with the first electrical contact and having a wettable surface facing the wettable surface of the first electrical contact;

a second signal conductor, electrically coupled to the second electrical contact;

a second conducting liquid volume in wetted contact with the second electrical contact; and a first actuator in a rest position, coupled to the first electrical contact and operable to move the first electrical contact towards the second electrical contact, to cause the first and second conducting liquid droplets to coalesce and complete an electrical circuit between the first and second electrical contacts, and away from the second electrical contact, to cause the first and second conducting liquid droplets to separate and break the electrical circuit.

2. An electrical relay array in accordance with claim 1, wherein the first actuator is one of a piezoelectric actuator and a magnetorestrictive actuator.

3. An electrical relay array in accordance with claim 1, wherein the first and second conducting liquid droplets are liquid metal droplets.

4. An electrical relay array in accordance with claim 1, further comprising a second actuator, coupled to the second electrical contact and operable to move the second electrical contact towards the first electrical contact, to cause the first and second conducting liquid droplets to coalesce and complete an electrical circuit, and away from the first electrical contact, to cause the first and second conducting liquid droplets to separate and break the electrical circuit.

5. An electrical relay array in accordance with claim 4, wherein the second actuator is one of a piezoelectric actuator and a magnetorestrictive actuator.

6. An electrical relay array in accordance with claim 1, wherein the volumes of the first and second conducting liquid droplets are such that coalesced droplets remain coalesced when the actuator is returned to its rest position, and separated droplets remain separated when the actuator is returned to its rest position.

7. An electrical relay array in accordance with claim 1, wherein the wettable surfaces of the first and second electrical contacts are stepped.

8. An electrical relay array in accordance with claim 1, wherein the first electrical contact is electrically coupled to the first signal conductors by a non-wettable, conductive coating on the first actuator.

9. An electrical relay array in accordance with claim 1, further comprising:

a ground shield, encircling the first and second electrical contacts and the first and second signal conductors; and a dielectric layer positioned between the ground shield and the first and second signal conductors, the dielectric layer electrically insulating the ground shield from the first and second signal conductors.

10. An electrical relay array in accordance with claim 1, wherein the relay array comprising one or more levels, each level of the one or more levels comprising:

a lower cap layer supporting electrical connections to the first actuator;

an upper cap layer; and a switching layer positioned between the lower cap layer and the upper cap layer and having a plurality of channels formed therein;

wherein the first actuator, the first and second electrical contacts and the first and second signal conductors are positioned within a channel of the plurality of channels.

11. An electrical relay array in accordance with claim 10, further comprising:

a first end cap supporting electrical connections to the first signal conductor of each relay element; and a second end cap supporting electrical connections to the second signal conductor of each relay element.

12. An electrical relay array in accordance with claim 11, wherein the electrical connections to the first actuator comprise traces deposited on the surface of the lower cap layer and electrically coupled to connections on the first end cap.

13. An electrical relay array in accordance with claim 11, manufactured by a method of micro-machining.

14. An electrical relay array in accordance with claim 11, wherein the relay array comprises a rectangular grid of relay elements having a plurality of rows and a plurality of columns.

15. An electrical relay array in accordance with claim 14, further comprising:

for each row of the plurality of rows:

connection circuitry formed on the second end cap for coupling an input signal to the row; and for each column of the plurality of columns:

connection circuitry formed on the first end cap for coupling the column to an output.

16. An electrical relay array in accordance with claim 15, further comprising control circuitry operable to couple a selected input signal to a selected output through the relay array.

* * * * *